US007051638B2

(12) United States Patent
Thomele

(10) Patent No.: US 7,051,638 B2
(45) Date of Patent: May 30, 2006

(54) TRIGGER MECHANISM FOR SMALL FIREARMS

(75) Inventor: Adrian Thomele, Damendorf (DE)

(73) Assignee: S.A.T. Swiss Arms Technology AG, Neuhausen (CH)

( * ) Notice: Subject to any disclaimer, the term of this patent is extended or adjusted under 35 U.S.C. 154(b) by 0 days.

(21) Appl. No.: 10/954,158

(22) Filed: Sep. 29, 2004

(65) Prior Publication Data

US 2005/0108914 A1 May 26, 2005

Related U.S. Application Data

(63) Continuation of application No. PCT/EP03/14586, filed on Dec. 19, 2003.

(30) Foreign Application Priority Data

Feb. 12, 2003 (DE) ..... 103 05 682

(51) Int. Cl.
*F41A 19/51* (2006.01)

(52) U.S. Cl. ..... 89/147; 42/69.03

(58) Field of Classification Search ..... 89/147; 42/65–67, 69.01, 69.02, 69.03
See application file for complete search history.

(56) References Cited

U.S. PATENT DOCUMENTS

| | | | | |
|---|---|---|---|---|
| 2,464,427 | A * | 3/1949 | Wilson | 89/147 |
| 2,846,925 | A * | 8/1958 | Norman | 89/145 |
| 3,512,418 | A * | 5/1970 | Broman, Jr. | 73/863.43 |
| 3,722,358 | A | 3/1973 | Seecamp | |
| 3,857,325 | A * | 12/1974 | Thomas | 89/138 |
| 4,028,836 | A * | 6/1977 | Keppeler | 42/69.03 |
| 4,275,640 | A * | 6/1981 | Wilhelm | 89/147 |
| 4,428,138 | A * | 1/1984 | Seecamp | 42/70.02 |
| 5,160,796 | A * | 11/1992 | Tuma et al. | 42/69.03 |
| 5,216,195 | A * | 6/1993 | Tuma | 89/147 |
| 5,355,768 | A * | 10/1994 | Felk | 89/147 |
| 5,400,537 | A * | 3/1995 | Meller et al. | 42/69.03 |
| 5,625,971 | A * | 5/1997 | Tuma et al. | 42/70.08 |

FOREIGN PATENT DOCUMENTS

| | | |
|---|---|---|
| CH | 685262 | 5/1995 |
| DE | 31 11 037 | 10/1982 |
| DE | 195 45 338 | 5/1996 |

* cited by examiner

*Primary Examiner*—Michael J. Carone
*Assistant Examiner*—Troy Chambers
(74) *Attorney, Agent, or Firm*—Martin Fleit; Paul D. Bianco; Fleit Kain Gibbons Gutman Bongini & Bianco, P.L.

(57) ABSTRACT

A trigger mechanism for small firearms with a striking hammer, a trigger, and a trigger rail, which interacts with the trigger and which can be moved by a control element from an engagement position for cocking the striking hammer into a release position for releasing the cocked striking hammer. The control element is a control slide, which can be moved by the movement of an action during repetition of the small firearm and through which the trigger rail can be moved from its release position into a catch position for catching the striking hammer cocked during repetition.

14 Claims, 6 Drawing Sheets

TRIGGER MECHANISM FOR SMALL FIREARMS

RELATED APPLICATION

This application is a continuation of International Application No. PCT/EP03/014586 filed Dec. 19, 2003, the contents of which are here incorporated by reference in their entirety. Applicant claims the benefit of 35 USC Section 120.

BACKGROUND OF THE INVENTION

1. Field of the Invention

The invention pertains to a trigger mechanism for small firearms.

2. Prior Art

Trigger mechanisms of the type mentioned in the introduction are known, for which the striking hammer must first be cocked by the trigger for each shot. Through these so-called DAO (Double Action Only) trigger systems, a high degree of safety is guaranteed in a weapon since they exhibit a constant trigger resistance and they can be put away or laid down after shooting without additional uncocking. However, the conventional DAO trigger systems feature an unchangeable trigger path, so that both for discharging a first shot and also for discharging subsequent shots, a uniformly large movement of the trigger is required.

From CH 685 262 A5, a trigger mechanism of a small firearm with a hammer, trigger, and trigger rod interacting with these elements is known. In this known trigger mechanism, the trigger rod interacts with a sear, wherewith the hammer is held in a cocked position for the self-cocking operation (single action) and in a precooked position for operation with a cocked trigger (double action). For the operation of the weapon by means of a cocked trigger, the hammer is first moved through a contact breaker into the cocked position by moving the trigger rod until the rear end of the cocked rod is moved downwards over a stationary bevel. Simultaneously, the contact breaker is pivoted upwards, which breaks the contact between the trigger rod and the contact breaker. Therefore, the cock can be forced forwards for discharging a shot.

The problem of the invention is to create a trigger mechanism for small firearms, whose operation corresponds essentially to that of a DAO (Double Action Only) trigger system, but which has the ability to fire after the second shot with a significantly shortened trigger path.

This problem is solved by a trigger mechanism with the features of claim 1. Preferable configurations and advantageous refinements of the invention are given in the subordinate claims.

In the trigger mechanism according to the invention, after discharging the first shot, the trigger rail is brought from a lower trigger position into an upper catch position for repetition of the action by moving the control slide. Therefore, the striking hammer, which is likewise cocked during repetition, can be already caught again and held by the trigger before it reaches its completely uncocked forward starting position for discharging the next shot. If the trigger is not released by the safety after discharging the shot, then the next shot can be discharged with a significantly shortened trigger path. In contrast, if the trigger is released after the discharge of the shot, it moves back into its starting position and the total trigger path is again required for discharging the next shot. Therefore, a high degree of safety is guaranteed since the weapon cannot be put away after shooting without additional uncocking.

In one especially preferred configuration of the invention, the control slide can move perpendicular to the longitudinal axis of the small firearm between two side parts of a carrier element separated from each other. The control slide preferably contains a lower control radius, through which the trigger rail in the starting position of the control slide is moved into its trigger position for releasing the striking hammer. The control slide also contains a molded section, in which the trigger rail engages in the inwards pressed functional position of the control slide. In this way, the trigger rail moves into a catch position, in which the striking hammer, which is likewise cocked during repetition, can be caught.

To move the control slide, in a preferred configuration, there is a recess in which the control slide engages for a closed action in a side wall of the action overlapping the control slide. When the action is shifted due to the recoil during the shot discharge, the control slide comes out of engagement with the recess and is pressed inwards into its functional position. In this position, the trigger rail jumps into the molded section of the control slide provided for this function, which provides an overlap between a catch of the trigger rail and a firing lock on the striking hammer. Simultaneously, the control slide is held by the trigger rail in its inwards pressed functional position. If the striking hammer, likewise cocked by the backwards movement of the action, then returns to its starting position, it comes back into engagement with the trigger rail before reaching its starting position and pushes it back, so that the control slide moves back into its starting position. In this position, the discharging of a new shot is possible with considerably shortened trigger path.

The control slide contains a guide pin and a control pin perpendicular to it. The control pin is arranged so that it extends outwards into a corresponding opening of the side part of the carrier element facing the trigger rail. On the guide pin, there is a compression spring, through which the control pin of the control slide is pressed to the adjacent side wall of the action.

BRIEF DESCRIPTION OF THE DRAWINGS

Other details and advantages of the invention result from the following description of a preferred embodiment with reference to the drawing. Shown are.

i)

DETAILED DESCRIPTION OF PREFERRED EMBODIMENTS OF THE INVENTION

The trigger mechanism shown schematically in FIGS. 1—5 for a small firearm contains a striking hammer 1, a trigger 2, and a trigger rail 3, which is in an articulating connection with this trigger and by means of which the striking hammer 1 is first cocked against the force of a (not-shown) striking hammer spring during the activation of the trigger 2 and then is released for discharging a shot.

Figure 1B:
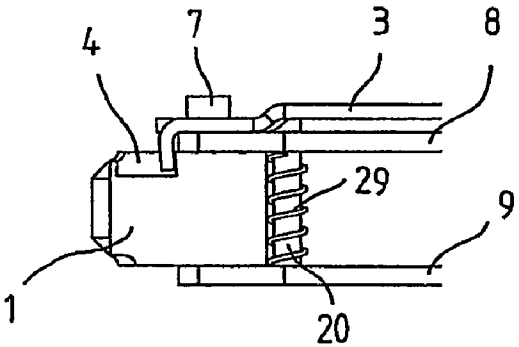
FIGS. 1A, B and C show a trigger mechanism according to the invention for a small firearm in a starting position with completely uncocked striking hammer in a side view (FIG. 1A), bottom view (FIG. 1B), and a section along line I—I (FIG. 1C)
Figure 1A:
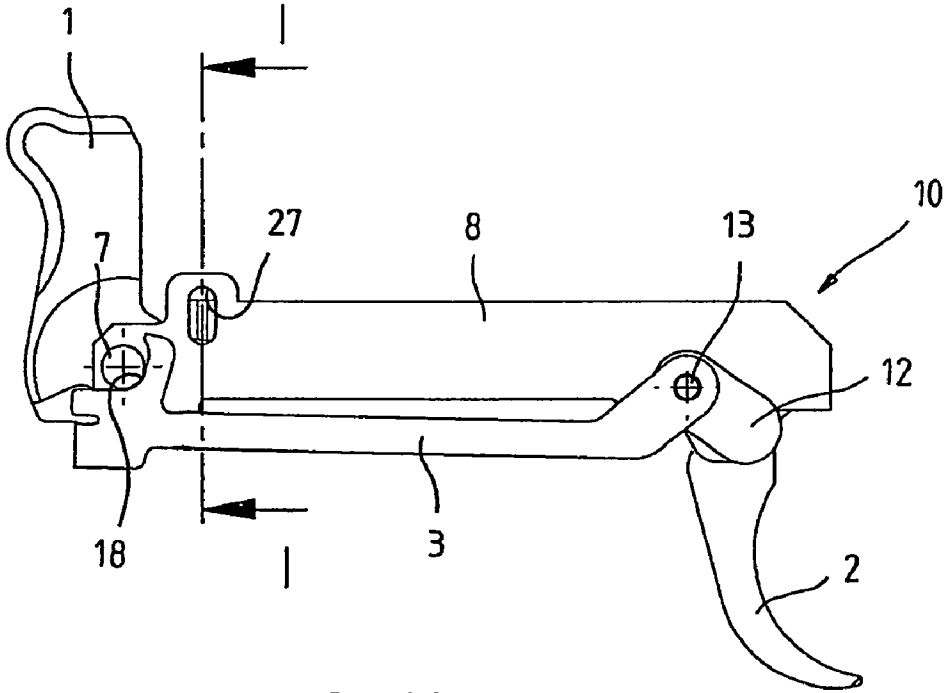
Figure 1C:
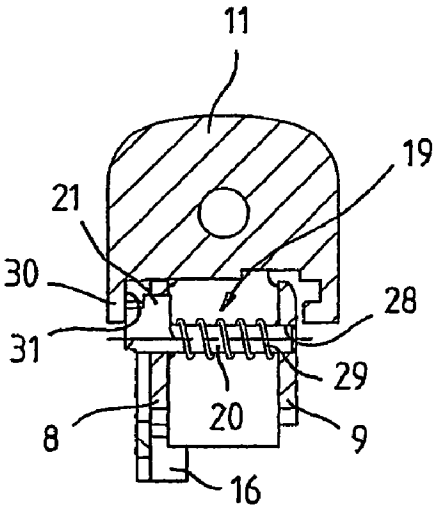
Figure 2B:
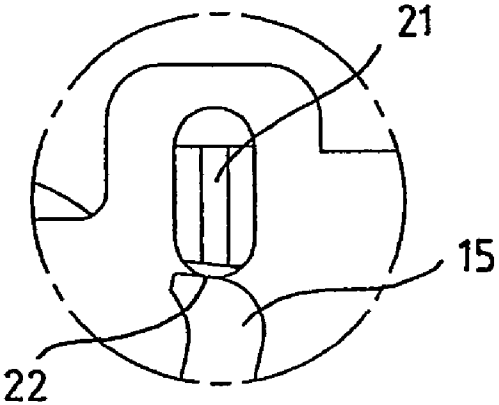
FIGS. 2A and B show the trigger mechanism shown in FIG. 1 in a trigger position in a side view (FIG. 2A) and an enlarged detail view (FIG. 2B)
Figure 2A:
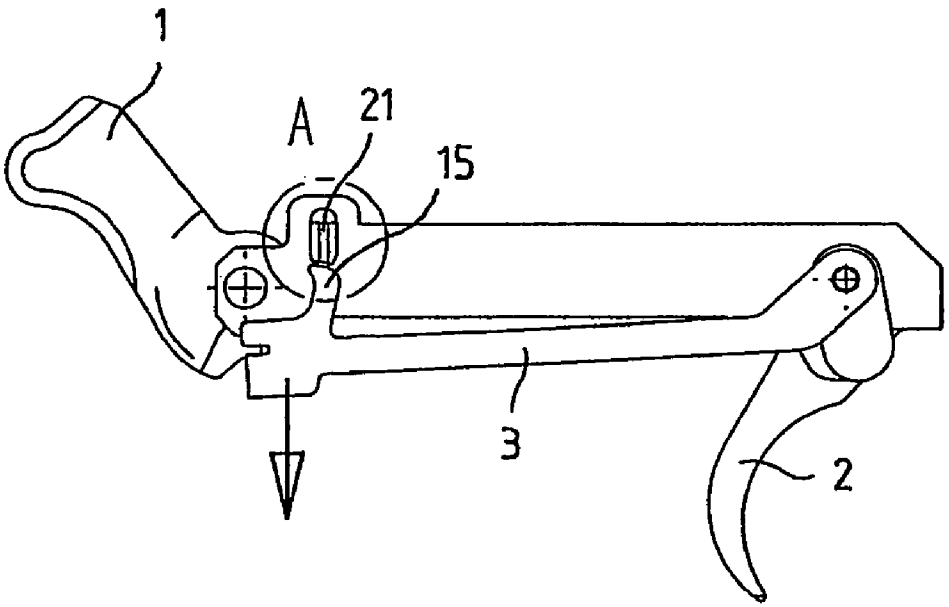
Figure 3A:
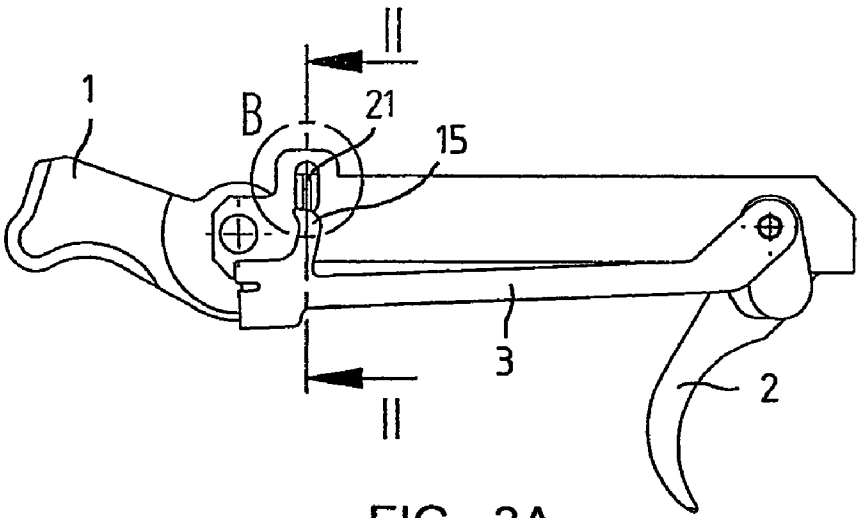
FIGS. 3A, B and C show the trigger mechanism shown in FIG. 1 during opening of the action in a side view (FIG. 3A), an enlarged detail view (3B) and a section taken along line II—II (FIG. 3C)
Figure 3B:
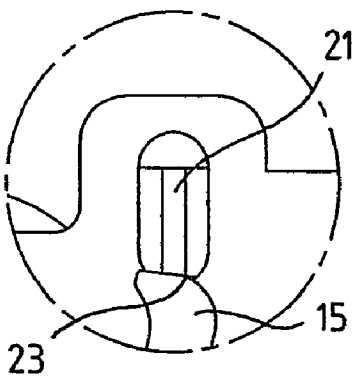
Figure 3C:
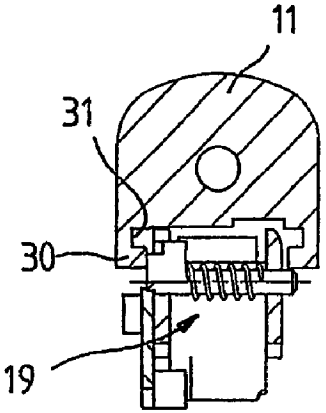
Figure 6:
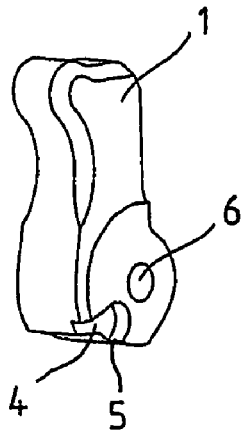
FIG. 6 is a schematic perspective view of the striking hammer of the trigger mechanism shown in FIGS. 1—5.

As can be seen, especially in FIG. 6, the striking hammer 1 contains a free molded section 4 with a firing lock 5 on its side facing the trigger rail 3. The striking hammer 1 also has a cross hole 6 arranged above the free molded section 4 for a striking hammer shaft 7, by means of which the striking hammer 1 is arranged so that it can pivot between two side parts 8 and 9 of a carrier element 10 shown in FIG. 1. By means of the carrier element 10, an action 11 shown only in the side views of FIGS. 1 and 3 is movable. The trigger 2 that can pivot on the carrier element 10 contains a side hinge part 12 pointing upwards diagonally with a hinge pin 13 extending to the side, on which the front end of the trigger rail 3 is hinged. The trigger 2 is embodied in one piece with the hinge part 12 and the hinge pin 13.

Figure 7:
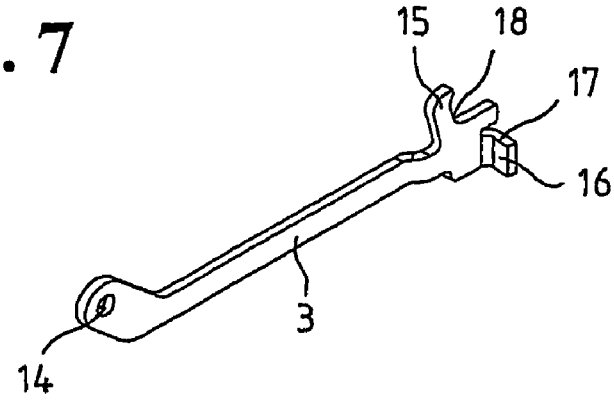
FIG. 7 is a schematic perspective view of the trigger rail of the trigger mechanism shown in FIGS. 1—5; and ii)

The trigger rail 3 shown separately in FIG. 7 has on its front end angled upwards a hole 14 for placing on the hinge pin 13 of the trigger 2 extending laterally. On its inwards crimped rear end, the trigger rail 3 contains a control cam 15 extending upwards and a catch 16 pointing inwards with a locking edge 17 for engaging in the lateral free molded section 4 of the striking hammer 1. In the configuration shown, the catch 16 consists of a rear section of the trigger rail 3 bent inwards at a right angle. In front of the control cam 15, there is a rounded contact surface 18, with which the trigger rail 3 comes into contact in the starting position of the trigger mechanism shown in FIG. 1 on a part of the striking hammer shaft 7 extending outwards from the side part 7. Force is exerted on the trigger rail 3 rearwards by a (not-shown) trigger spring acting on the trigger 2 in its forward starting position and upwards by a trigger rail spring (also not shown).

Figure 8:
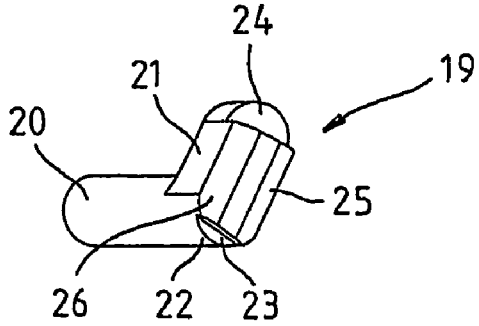
FIG. 8 is a schematic perspective view of the control slide of the trigger mechanism shown in FIGS. 1—5.

There is further a control slide 19 shown individually in FIG. 8 between the two side parts 8 and 9 of the carrier element 10. This consists of a guide pin 20 and an oval control pin 21 at a right angle thereto and which contains a control radius 22 and also a molded section 23 on its bottom side. The control pin 21 has a molded section 24 on its top side. In addition, there are lateral contact bevels 25 and 26 on the outwards projecting end surface of the control pin 21.

As can be seen from FIG. 1, the oval control pin 21 of the control slide 19 extends outwards into a corresponding opening 27 in the side part 8 facing the trigger rail 3. The guide pin 20 of the control slide 19 is guided with its free end into a corresponding hole 28 of the side part 9. On the guide pin 20, there is a compression spring 29 compressed between the side part 9 and the control section 21. By means of this spring, the control pin 21 of the control slide 19 is pressed with its end surface extending outwards from the side part 8 against a side surface 30 of the action 11.

In the following, the function of the trigger mechanism according to the invention is explained with reference to FIGS. 1—5.

In the starting position of the trigger mechanism shown in FIG. 1, the trigger 2 is located in its forward starting position. The rear end of the trigger rail 3 spring-loaded upwards is positioned with the contact surface 18 on a part of the striking hammer shaft 7 extending laterally. The striking hammer 1 is completely uncocked in this position and the control slide 19 assumes a starting position shown in section I—I. In this starting position, the outwards projecting control pin 21 of the control slide 19 engages in a lateral recess 31 in the side wall 30 of the action 11.

In the activation of the trigger 2, the striking hammer 1 is cocked by the trigger rail 3 against the (not-shown) striking hammer spring. As soon as the control cam 15 of the trigger rail 3 contacts the control radius 22 of the control slide 19 located in the starting position, the trigger rail 3 is moved downwards according to FIG. 2 in the direction of the arrow until the locking edge 17 of the trigger rail 3 emerges from the firing lock 5 of the striking hammer 1 in a lower trigger position and this is released for discharging a shot.

After successful ignition, the action 11 of the small firearm is accelerated in the direction of the striking hammer 1 due to the recoil. Therefore, the striking hammer 1 is cocked. Simultaneously, the control pin 21 of the control slide 19 extending outwards leaves the recess 31 of the side wall 30, whereby the control slide 19 is pressed out of its starting position shown in FIG. 1 inwards into a functional position shown in section II—II of FIG. 3. In this functional position of the control slide 19, the trigger rail 3 jumps into the lower molded section 23, so that the catch 16 of the trigger rail 3 stands in the free molded section 4 of the striking hammer 1 and there is an overlap with the firing lock 5. In this raised catch position of the trigger rail 3, the striking hammer 1 returning into its starting position after the repetition can be caught by the trigger rail 3 before it reaches its completely uncocked forward starting position. Simultaneously, the control slide 19 is fixed in this functional position.

Figure 4B:
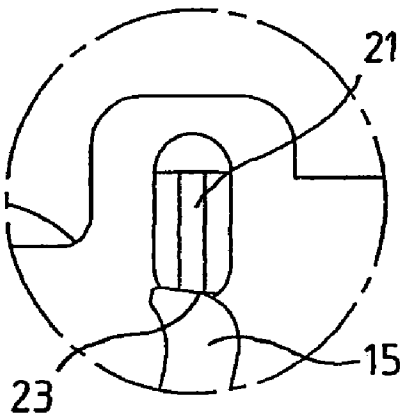
FIGS. 4A and B show the trigger mechanism shown in FIG. 1 while the striking hammer is pivoted back into the starting position in a side view (FIG. 4A) and an enlarged detail view (FIG. 4B)
Figure 4A:
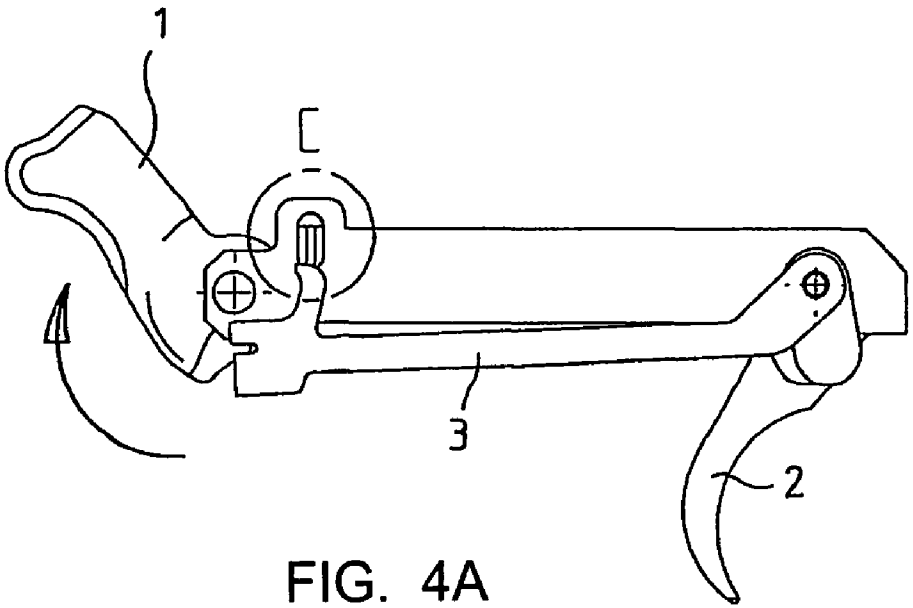

After the action block 11 is located again in its starting position, the cocked striking hammer 1 moves according to FIG. 4 in the direction of the arrow until it is caught by the catch 16 of the trigger rail 3, which is still located in the position shown in FIG. 3.

Figure 5A:
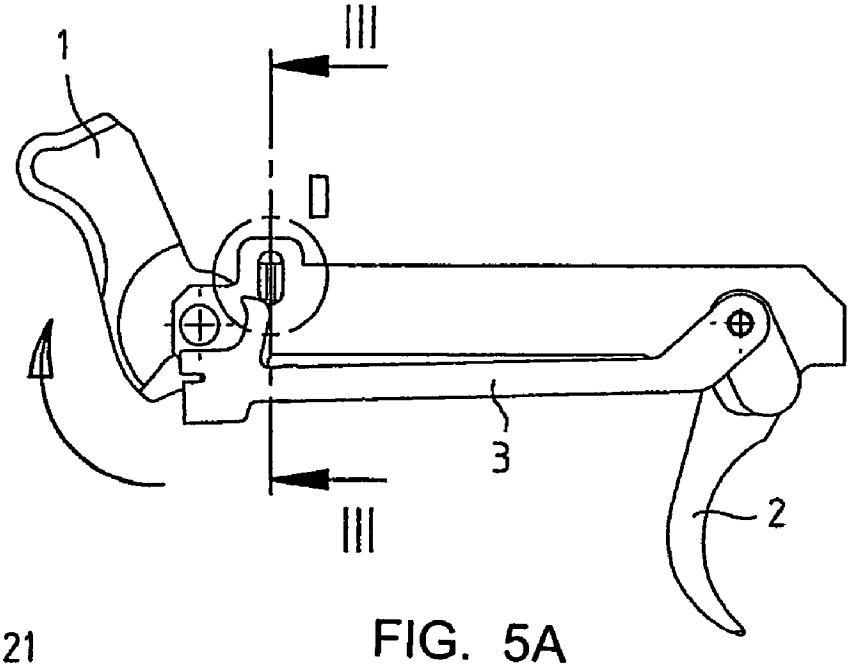
FIGS. 5A, B and C show the trigger mechanism shown in FIG. 1 in a position for discharging another shot with shortened trigger path in a side view (FIG. 5A), an enlarged detail view (FIG. 5B) and a cross sectional view taken along line III—III (FIG. 5C)
Figure 5B:
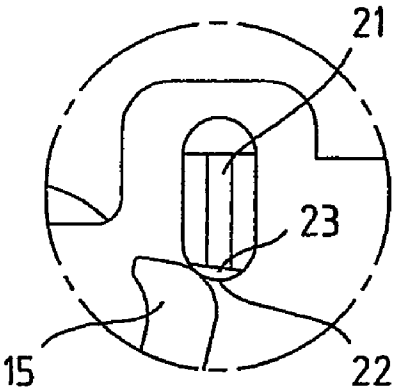
Figure 5C:
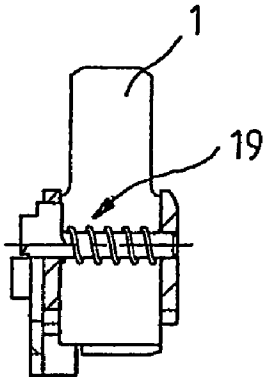

Through the further forward movement of the cocked striking hammer 1 in the direction of the arrow of FIG. 5, the control cam 15 of the trigger rail 3 is pushed out of the molded section 23 of the control slide 19, so that the control slide 19 moves into its starting position. In this position of the trigger mechanism, the discharging of a new shot is possible with a significantly shortened trigger path.

What is claimed is:

1. Trigger mechanism for small firearms comprising:

a striking hammer movable from a un-cocked position to a cocked position;

a trigger;

a trigger rail including a first end pivotally connected to the trigger and a second end positioned in engagement with the striking hammer; and a control slide engageable with the second end of the trigger rail, wherein after a discharging of a first shot the control slide is actuated to move the trigger rail from a lower trigger position to an upper catch position such that the second end of the trigger rail catches the striking hammer prior to reaching the un-cocked position.

2. Trigger mechanism according to claim 1, further comprising a carrier element including first and second side parts and pivotally connected to the first end of the trigger rail and the trigger, wherein the control slide can move perpendicular to a longitudinal axis of the small firearm between the first and second side parts of the carrier element.

3. Trigger mechanism according to claim 1, wherein the control slide contains a control radius for moving the trigger rail in the lower trigger position and a molded section for receiving the trigger rail in the upper catch position.

4. Trigger mechanism according to claim 1, further comprising an action including a recess in which the control slide is engaged.

5. Trigger mechanism according to claim 2, wherein the control slide includes a guide pin and a control pin.

6. Trigger mechanism according to claim 5, wherein the control pin of the control slide extends outwards into an opening of the first side pan of the carrier element facing the trigger rail.

7. Trigger mechanism according to claim 5, wherein the control pin includes a diagonal contact surfaces on an end surface extending outwards.

8. Trigger mechanism according to claim 4, wherein the control slide is pressed against an adjacent side wall of the action by a compression spring.

9. Trigger mechanism according to claim 1, wherein the trigger rail includes a control cam for engagement wit the control slide.

10. Trigger mechanism according to claim 1, wherein the striking hammer has a lateral free molded section with a firing lock to engage a catch on the trigger rail.

11. A trigger mechanism for small firearms comprising:

a trigger rail including a first end and a second end;

a trigger pivotally connected to the first end of the trigger rail and movable from a first trigger position to a second trigger position defining a first trigger path;

a striking hammer positionable in engagement with the second end of the trigger rail, such that as the trigger is moved along the first trigger path the second end of the trigger rail engages the striking hammer, moving the striking hammer from a un-cocked position to a cocked position and disengages the striking hammer to discharge a first shot; and a control slide engageable with the second end of the trigger rail, wherein after the discharging of the first shot the control slide is actuated to move the trigger rail from a lower trigger position to an upper catch position such that the second end of the trigger rail catches the striking hammer at an intermediate position interposed between the un-cocked and the cocked position.

12. A trigger mechanism for small firearms as set forth in claim 11, wherein when the striking hammer is in the intermediate position, the trigger is movable from a third position to the second position defining a second trigger path.

13. A trigger mechanism for small firearms as set forth in claim 12, wherein the first trigger path defines a first travel distance and the second trigger path defines a second travel distance less then the first travel distance.

14. A trigger mechanism for small firearms as set forth in claim 11, further comprising a carrier element including first and second side parts and pivotally connected to the first end of the trigger rail and to the trigger, wherein the control slide in positionable between the first and second side parts of the carrier element and is moveable perpendicular to a longitudinal axis of the snail firearm between the first and second side parts of the carrier element.

* * * * *